US005520332A

United States Patent [19]

Gaidis et al.

[11] Patent Number: 5,520,332

[45] Date of Patent: May 28, 1996

[54] METHOD AND APPARATUS FOR SPRAY APPLYING FIREPROOFING COMPOSITIONS

[75] Inventors: James M. Gaidis, Ellicott City; Brian S. Gilbert, Columbia; Arnold M. Rosenberg, Potomac, all of Md.

[73] Assignee: W. R. Grace & Co. - Conn., New York, N.Y.

[21] Appl. No.: 400,631

[22] Filed: Mar. 7, 1995

Related U.S. Application Data

[63] Continuation of Ser. No. 61,191, May 12, 1993, abandoned.

[51] Int. Cl.[6] ..... B05B 7/06

[52] U.S. Cl. ..... 239/8; 239/61; 239/107; 239/419.3; 239/424; 239/533.12

[58] Field of Search ..... 239/8, 9, 61, 107, 239/533.12, 533.13, 601, 428, 425.5, 433, 419, 419.3, 424

[56] References Cited

U.S. PATENT DOCUMENTS

| | | | |
|---|---|---|---|
| 1,613,795 | 1/1927 | Herold | 239/8 |
| 2,558,681 | 6/1951 | Hachmeister | 239/61 |
| 2,671,692 | 3/1954 | Matirko | 299/140 |
| 3,077,415 | 2/1963 | Ayers | 106/75 |
| 3,719,513 | 3/1973 | Bragg et al. | 106/114 |
| 3,740,260 | 6/1973 | Winn | 239/8 X |
| 3,839,059 | 10/1974 | Rothfelder et al. | 106/115 |
| 4,302,481 | 11/1981 | Ribnitz et al. | 239/8 X |
| 4,751,024 | 6/1988 | Shu et al. | 252/601 |
| 4,904,503 | 2/1990 | Hilton et al. | 427/373 |
| 4,923,121 | 5/1990 | Boyer | 239/9 X |
| 4,934,596 | 6/1990 | Hilton et al. | 239/8 |

FOREIGN PATENT DOCUMENTS

| | | | |
|---|---|---|---|
| 484914 | 7/1952 | Canada | 239/533.13 |
| 2541911 | 9/1984 | France . | |
| 916249 | 10/1954 | Germany | 239/533.12 |
| 439476 | 12/1935 | United Kingdom . | |
| 2100327 | 12/1982 | United Kingdom . | |

*Primary Examiner*—Andres Kashnikow
*Assistant Examiner*—Kevin Weldon
*Attorney, Agent, or Firm*—Craig K. Leon; William L. Baker

[57] ABSTRACT

A method and apparatus for controlling the flow rate of relatively low viscosity fluids, such as accelerators, in viscous, hydraulic slurry spray application systems. An adjustable accelerator flow control system which regulates excess air pressure supplied to the accelerator pump in response to height variations of the spray nozzle is provided. The system is especially useful with fireproofing compositions since it provides effective distribution and constant flow of a viscous, hydraulic cementitious slurry with an acidic accelerator.

9 Claims, 4 Drawing Sheets

METHOD AND APPARATUS FOR SPRAY APPLYING FIREPROOFING COMPOSITIONS

This is a continuation of application Ser. No. 08/061,191, filed on May 12, 1993, now abandoned.

BACKGROUND OF THE INVENTION

It is well known to spray apply hydraulic cementitious slurries onto metal structural members in order to provide a heat resistant coating thereon. U.S. Pat. Nos. 3,719,513 and 3,839,059 disclose gypsum-based formulations which contain, in addition to the gypsum binder, a lightweight inorganic aggregate such as vermiculite, a fibrous substance such as cellulose and an air entraining agent for such purpose. U.S. Pat. No. 4,751,024 teaches sprayable cementitious compositions containing shredded polystyrene as a lightweight aggregate in fireproofing compositions. Such slurries are generally prepared at ground level and are pumped to the point of application, where they are spray applied to the substrate. Often the point of application exceeds 20 or 30 stories where high rise construction is involved, and the slurry is generally applied through a spray nozzle.

Slurries must possess a number of important properties to be suitable as heat resistant coatings. First, they must be sufficiently fluid to be pumped easily and to great heights. Second, they must retain a consistency sufficient to prevent segregation or settling of ingredients and provide an adequate "yield" or volume of applied fireproofing per weight of dry mix. Third, they must adhere to the metal the structure member is comprised of, both in the slurried stated and after setting. Fourth, the slurry must set without undue expansion or shrinkage which could result in the formation of cracks that can deter from the insulative value of the coating.

U.S.. Pat. No. 4,934,596 of Hilton et al., owned by the common assignee herein, the disclosure of which is incorporated herein by reference, teaches a slurry distributor for distributing a low viscosity fluid such as an accelerator into a viscous, hydraulic slurry. Specifically, the low viscosity fluid is introduced into the flowing high viscosity slurry, and means is provided in the distributor for directing the low viscosity fluid so that it may be substantially evenly dispersed (such as with air) with the slurry onto the steel member. In one embodiment, the means for directing the low viscosity fluid is an air stem appropriately positioned in the distributor to intersect the flow of the slurry.

One difficulty encountered in spray applying multi-component blends such as cementitious slurries and set accelerators therefor is variable flow rates, in view of the back pressures which can develop in the system. If such back pressures are not carefully regulated, varying amounts of accelerator, for example, may be added to the slurry, causing inconsistencies in the resulting fireproofing coating.

SUMMARY OF THE INVENTION

The problems of the prior art have been overcome by the instant invention, which provides a method and apparatus for controlling the rate of flow of one or more components, such as controlling the rate of accelerator flow in cementitious slurry spray application systems. With reference to sprayable fireproofing compositions in particular, the present invention utilizes an adjustable accelerator flow control system which regulates excess air pressure supplied to the accelerator pump in response to height variations of the spray nozzle.

The spray nozzle or distributor receives a high viscosity slurry so that it flows toward a dispersing point, such as a dispensing orifice. A relatively low viscosity fluid is introduced in the distributor along the flow path of the high viscosity slurry. Means is provided in the distributor to direct and position the low viscosity fluid so that it may be substantially evenly dispersed with the slurry. The means to direct and position the low viscosity fluid may be a member which is positioned in the distributor to intercept the flowing low viscosity fluid and direct and position it appropriately relative to the slurry so that upon dispersion, the slurry and low viscosity fluid are substantially evenly dispersed The dispersion is accomplished by introduction of a gas, preferably air, in proximity to the dispensing orifice. An air injector may be used.

The distributor comprises a conduit having an orifice and a first means for receiving a flowing slurry into the conduit. The distributor also comprises a second means for introducing a liquid into the conduit at a point downstream from the first means relative to the direction of flow, and a third means for directing the liquid toward the orifice. The third means is located at a point downstream from the first means relative to the direction of flow and being disposed in the conduit such that the liquid contacts the third means and is directed toward the orifice so that it can be substantially evenly dispersed with the slurry. The apparatus also comprises a fourth means for introducing a gas into the conduit for dispersing the slurry and the liquid from the orifice.

In the preferred embodiment, the apparatus of the invention can be characterized as a distributor for low viscosity fluids into viscous, hydraulic slurries, comprising a main conduit located on a first axis for conducting a flowing, viscous hydraulic slurry toward an orifice. The distributor is especially adapted for conducting a cementitious slurry. The distributor also has an air injector defined by a stem located on a second axis which intersects the main conduit and an orifice for introducing air into the viscous, hydraulic slurry to disperse it from the orifice. The distributor has a second means located on a third axis which intersects the main conduit and is upstream, relative to the direction of flow, from the orifice for introducing low viscosity fluid into the flowing slurry before the dispersing air has been introduced. The low viscosity fluid is preferably an accelerator, such as alum. The second means is preferably a check valve injector port comprising a plastic tube having a plurality of slits.

The low viscosity fluid is introduced so that it impinges on the air injector stem before dispersion. This can be done by injecting the low viscosity fluid with the third axis aligned towards the second axis or by injecting the air and low viscosity fluid into the slurry with the second and third axes substantially co-planar with each other and the first axis.

In its method aspects, the present invention encompasses a method for distributing a low viscosity fluid into viscous, hydraulic slurries at substantially constant flow rates.

DETAILED DESCRIPTION OF THE INVENTION

Figure 1:
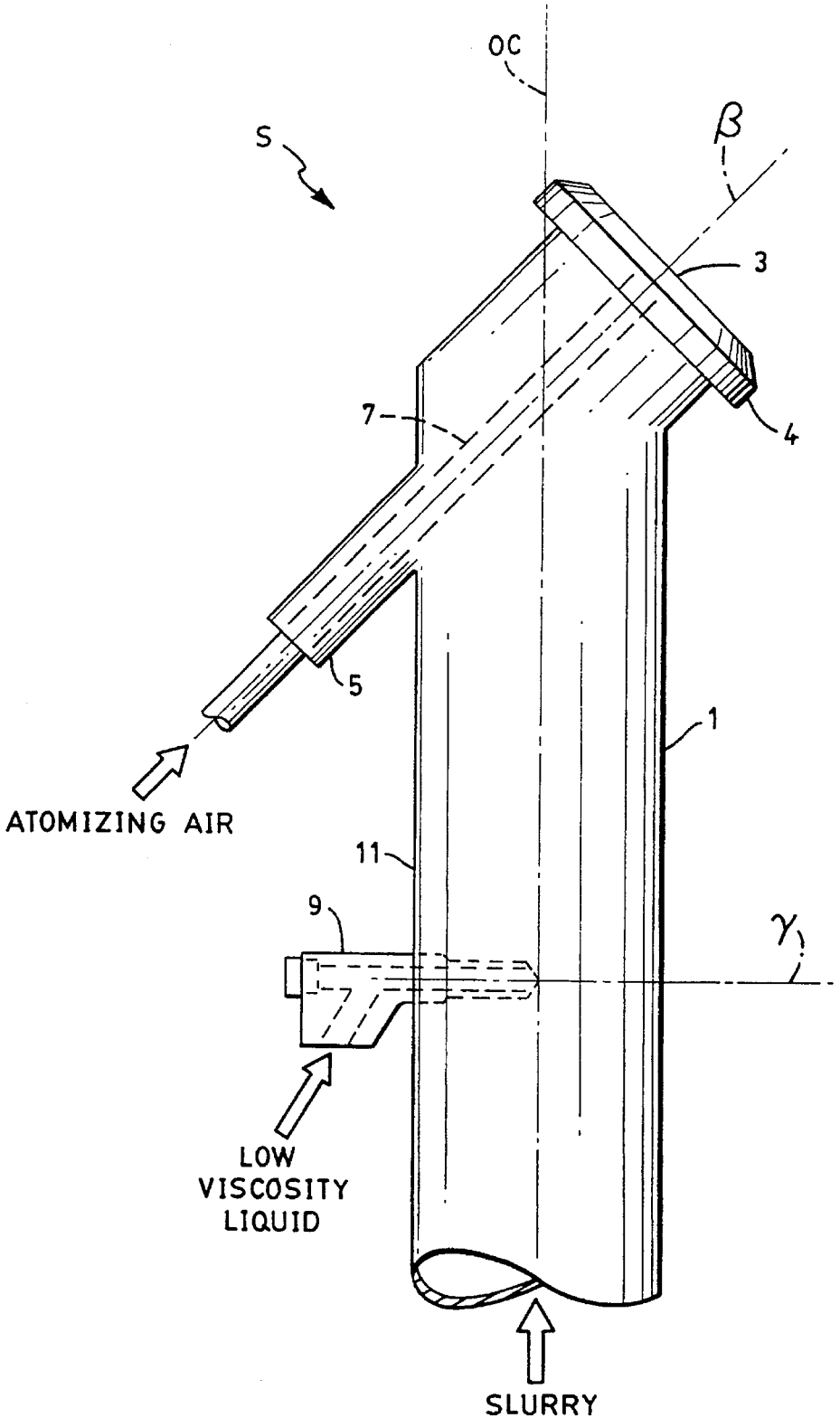
FIG.1 (PRIOR ART)
FIG. 1 is a slurry distributor in accordance with the prior art.

Referring now to FIG. 1, a slurry distributor S in accordance with the prior art is shown, which comprises a main conduit 1 located on a first axis α for conducting a flowing, viscous hydraulic slurry toward an orifice 3. The distributor S further comprises an air injector 5 defined by a stem 7 located on a second axis β intersecting the main conduit and aligned with the orifice 3. The air injector 5 is for introducing air into the distributor to disperse its contents from the orifice 3. A second means 9 in the form of a low viscosity liquid injector is located on a third axis γ and intersects the main conduit 1. It is located upstream from the orifice 3, relative to the direction of flow, preferably about three inches to about six inches from the stem 7. The second injector means 9 is for introducing a low viscosity liquid into the flowing slurry before the dispersing air has been introduced. The low viscosity liquid is introduced into the slurry to impinge on the strategically located air injector stem 7 before dispersion. One way of introducing the low viscosity liquid into the slurry so that it impinges on the air injector stem 7 is by constructing the distributor so that the first axis α, second axis β and third axis α are substantially co-planar, preferably co-planar.

The location of the flowing low viscosity fluid is substantially in juxtaposition to a wall of the distributor. The directing and positioning means can therefore be appropriately located to intercept the stream and direct it toward the orifice so that it can be substantially evenly dispersed with the slurry. The means for directing and positioning the low viscosity fluid can be the stem 7 of the air injector 5 which is strategically located to intercept the flowing low viscosity fluid. The low viscosity fluid then flows along the stem 7 and is thereby directed toward the orifice 3. The stem 7 is substantially centrally located with respect to the flowing slurry, so that as the low viscosity fluid reaches the nozzle end of the air injector 5, it is appropriately positioned to be substantially evenly dispersed with the slurry to achieve an acceptable spray pattern.

The main conduit 1 can have an inside diameter preferably of from one inch to 1.25 inches. The distributor S can be made of any material capable of conducting a hydraulic, viscous slurry, preferably stainless steel or aluminum.

The air injector 5 is defined by a stem 7 located on a second axis β which intersects the main conduit 1. The stem is movable lengthwise along the second axis β relative to the nozzle 4. The stem has to intersect the main conduit 1 only to the extent necessary to serve as a target for the low viscosity fluid and to the extent necessary to provide atomization of the components for acceptable spray application.

Figure 2:
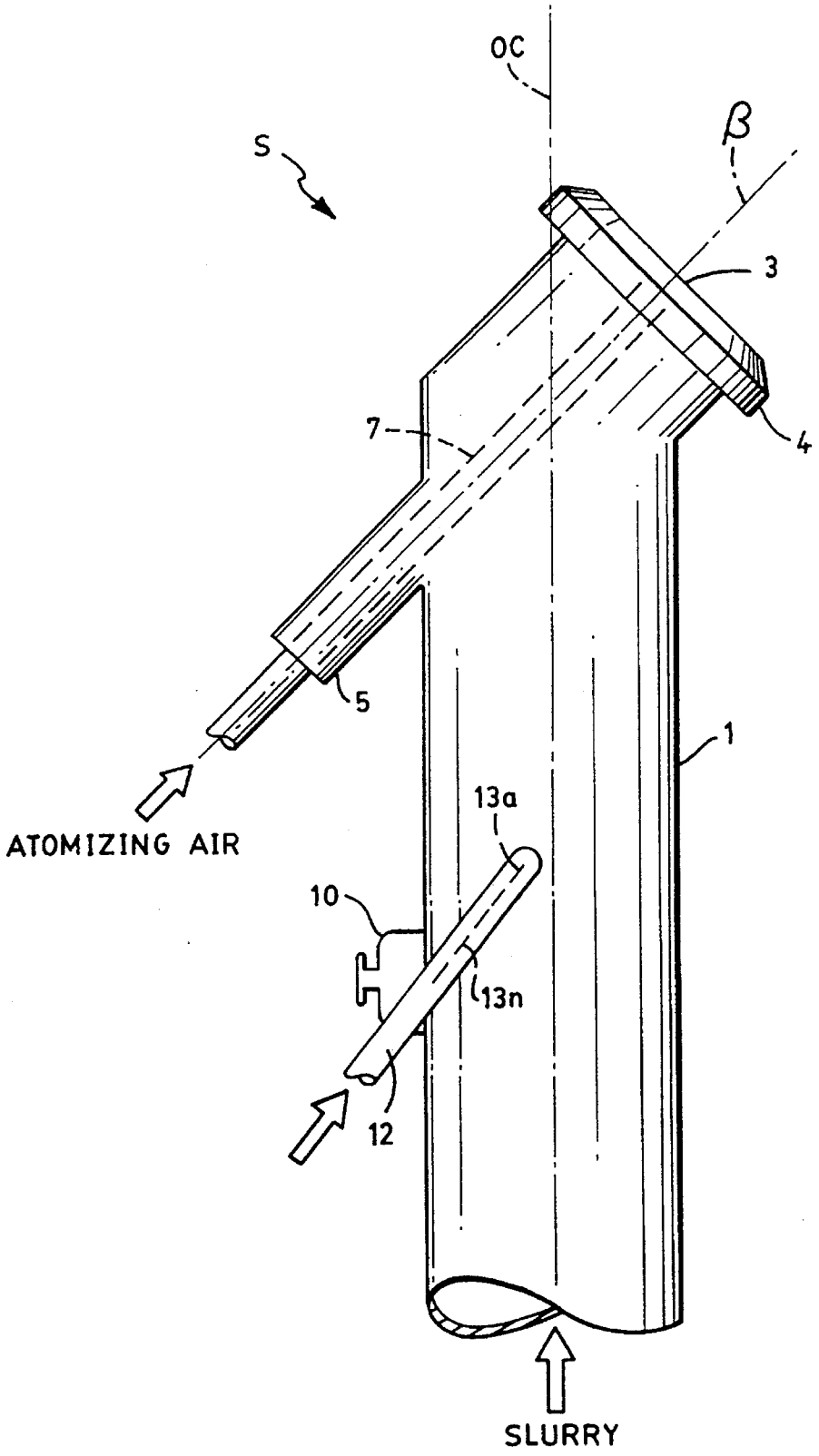
FIG. 2 is a slurry distributor modified in accordance with the instant invention.

Turning now to FIG. 2, the distributor S of FIG. 1 is shown in its modified form in accordance with the present invention. Specifically, the improved distributor of FIG. 2 uses a combined check-valve-injector port 10 instead of the standard injector of the prior art. A tube 12 with a closed end and preferably having a plurality of slits **13*a*–13*n* along its length is inserted into the main conduit 1. Preferably the tube 12 projects into the conduit about two inches and at about a 45° angle. The tube has a ¼ inch outer diameter and a ⅛ inch inner diameter. The slits are about ⅛ to ¼ inch long and can be formed using a knife or sharp razor. Preferably the tube 12 is made of a stretchable material which allows the tube to expand so that the slits pop open. Suitable materials include plastic, rubber and polyurethane, with the latter being preferred. The low viscosity liquid is introduced into the proximal exposed end of the tube 12. The liquid flows through the tube, and when the pressure supply to the low viscosity liquid is higher than the high viscosity liquid (slurry) pressure, the former emits from the plurality of slits and into the flowing high viscosity hydraulic slurry in the main conduit. If there is a surge in high viscosity slurry pressure, the plurality of slits on tube 12 close, thereby preventing infiltration of slurry, which could otherwise cause blockage in tube 12. If tube 12** is devoid of slits, but has an open end, the check valve can operate to keep pressure surges from causing the hydraulic slurry from backing up into the low viscosity fluid line and setting, thereby plugging the low viscosity fluid line.

Figure 3:
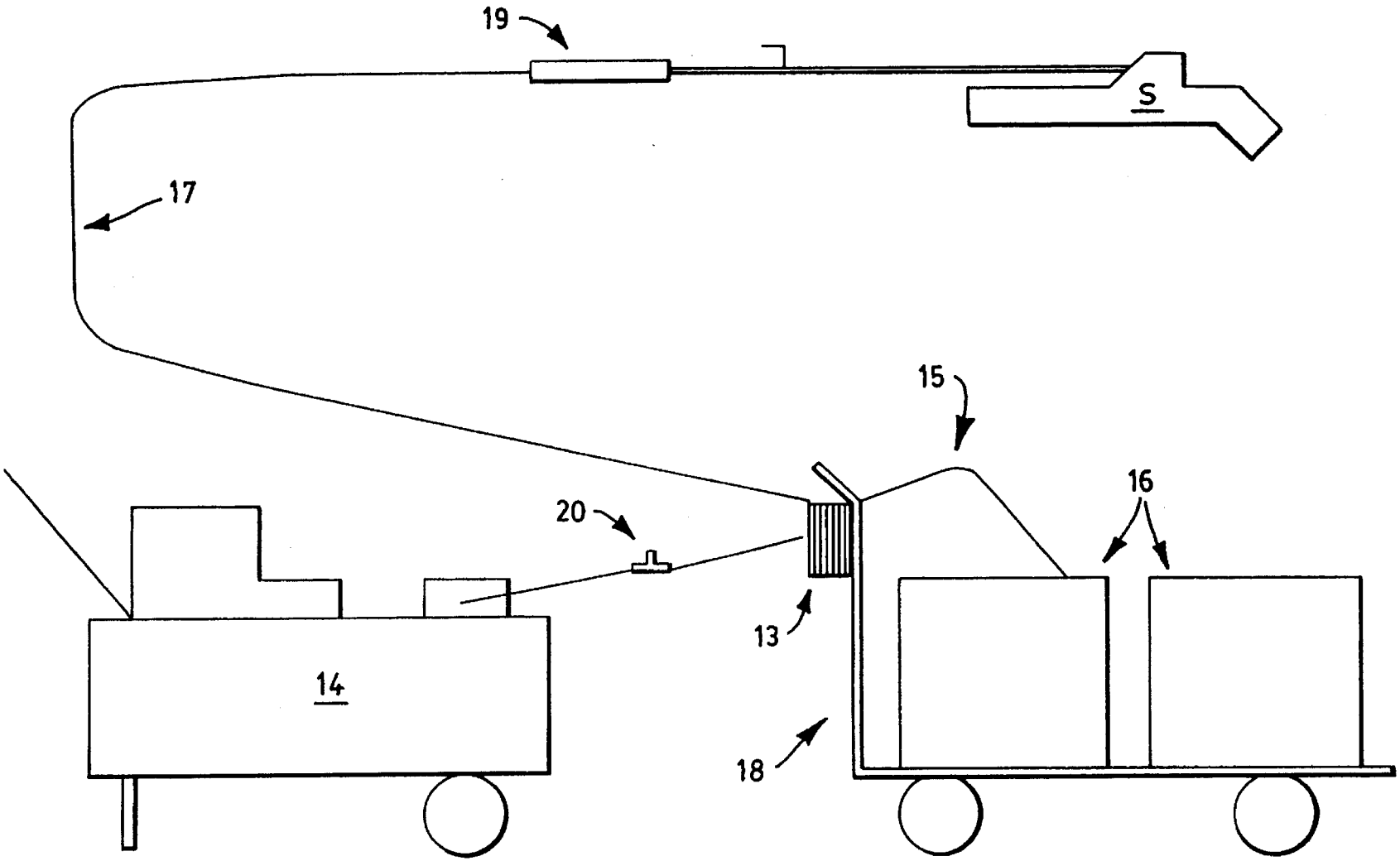
FIG. 3 is a schematic view of the spray application system in accordance with the instant invention.

Turning now to FIG. 3, there is illustrated a system for regulating the low viscosity liquid flow in accordance with one embodiment of the present invention. A suitable pressurized air source such as a compressor 14 delivers air up to 80 psi through a needle valve 20 to a Bellofram pump 13. The pump 13 uses the air pressure to pump the low viscosity liquid from storage containers 16 supported on cart 18, through ¼ inch braided PVC tubing 15, into ⅜ inch ID tubing 17 and into the slurry distributor S. A flow indicator 19 is placed in line to register the flow of low viscosity liquid. The flow of low viscosity fluid is controlled by varying the air pressure on the pump 13 with valve 20.

The pump 13 is a double-diaphragm air-pressure operated pump such as might be used for transferring beverages or other liquids. Suitable pumps include smaller pumps such as the Bellofram pump which are rated at 80 psi maximum operating pressure, as well as larger, heavy-duty pumps for industrial applications, which may use up to 125 psi of air pressure.

To protect the pump from excess pressure, it is common practice to utilize a pressure regulator to keep the pump from being over-pressurized. In fact, the pressure regulator is the usual control for setting a desired liquid flow rate. In an alum pumping circuit, for example, with no flow controller or needle valve, no alum would flow until the applied air pressure exceeded about 11 psi (7 psi for the pump and 4 psi for the check valve). As the alum fluid flow is increased up to useful levels for slurry injection, an additional 3 psi of pressure is needed to overcome friction losses in several hundred feet of tubing. The air pressure required for various alum liquid flows would then be a function of three quantities: the pump pressure (7 psi to start, but the pump may behave non-linearly, and can deliver many liters per minute at as little as 15 psi); the check valve opening pressure (approximately constant at 4 psi); and the supply tubing friction loss (roughly linear with the amount of liquid flow, but usually in the range of 2–5 psi). Accordingly, it is convenient to increase the air pressure to the pump from zero until the pump starts pumping, and to continue increasing the pressure, and thus the flow of alum, until the increased air pressure supplied meets the extra demands of fluid friction and other minor losses at the desired alum liquid flow. In this case, about 14 psi air pressure would be required to pump alum at about 0.5 liters/minute.

Figure 4:
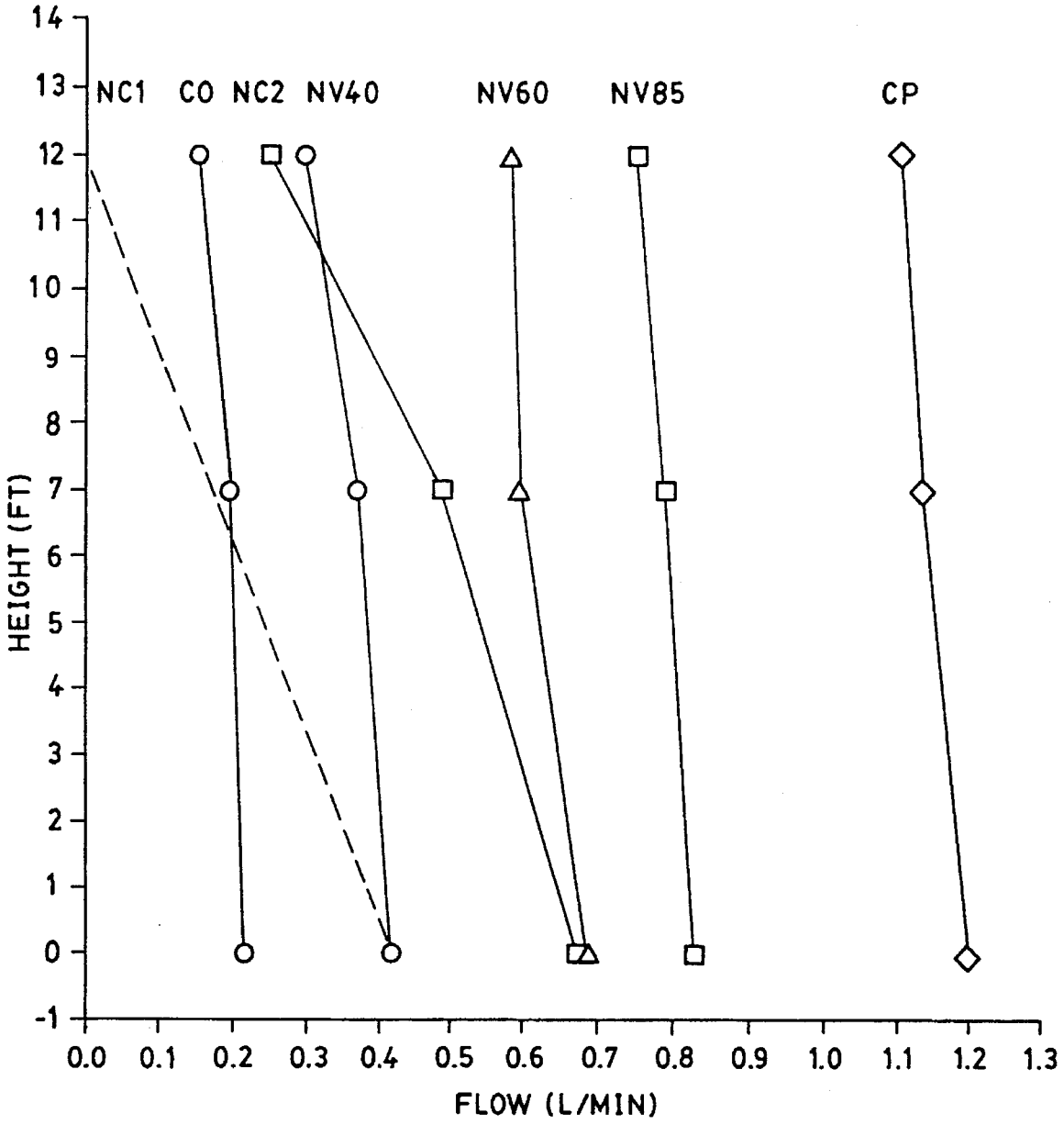
FIG. 4 is a graph showing the effects of height on flow rate.

An additional variable exists, however, when spray applying hydraulic cementitious slurries as fireproofing. If the accelerator (such as alum) flow is set properly at floor level and the applicator raises the spray nozzle above his head (about 12 feet of height differential), an additional back pressure of about 7 psi will be developed, which is sufficient to totally shut off the pump (14 psi air supply+7 psi alum head+4 psi check valve, which leaves only 3 psi to operate the pump and force fluid through the lines; since the pump needs 7 psi to start, no pumping occurs). FIG. 4, in which slurry and alum composition are constant and alum flow, nozzle height, air pressure supplied and pumping circuit configuration are varied, illustrates this phenomenon in curve NC1. If the regulated pressure is increased to 22 psi (curve NC2 in FIG. 4), alum flow may be maintained over this height differential, but goes from too high a flow rate (0.68 liters/minute) to too low a flow rate (0.26 liters/minute), dropping by 60%, and cannot be set to give a desired flow rate over a height difference for the nozzle positions.

One way to compensate for this is to include a flow controller in the alum line coming from the pump (curves CP and CO in FIG. 4). However, flow controllers are expensive, are subject to corrosion, require maintenance, and must be mounted on the nozzle to prevent flow differentials due to nozzle height effects on alum back pressures. Such a nozzle would be heavy and unwieldy, making it undesirable in the field.

In order to overcome the foregoing difficulties and disadvantages, in accordance with the present invention a needle (high restriction) valve 20 such as a forged metering valve is included in the air line, and the regulated air pressure is set higher (but preferably not above the pump maximum pressure rating). This provides extra air pressure in reserve to compensate for alum back pressure variations. With the use of a needle valve restriction and increased air supply pressure, a desired flow of 0.5 liters/minute could be obtained at floor level with about 60 psi air supply: 7–8 psi on the pump; 4 psi on the check valve; 3 psi in the tubing; and 46 psi dropped through the needle valve restriction. When the nozzle is raised twelve feet, the 60 psi supply, 7–8 psi pump pressure, 4 psi check valve, and 3 psi tubing pressure drop remain the same, but the 5 psi alum head back pressure is balanced by a drop in pressure across the needle valve from 46 psi to 41 psi, a relatively small change that only slightly changes the pump operation. A preferred valve is the HOKE MilliMite forged metering valve, 1300 series, having a $C_v$ of 0.028. This particular valve has 18 turns and therefore allows for fine tuning of the valve opening. The pressure drop across this valve having a 0.028 $C_v$ rating has been found to be suitable to enable the pump to pump accelerator (alum) up to 0.5 liters/minute. If it is desired to pump more accelerator, valves with higher $C_v$ ratings can be used.

Curves NV85, NV60 and NV40 of FIG. 3 show results obtained when the flow controller was omitted, the needle valve was adjusted to provide a desired flow rate, and the air pressure regulator was set at 85 psi, 60 psi and 40 psi respectively. The nozzle height was varied over a distance of 12 feet with only minor alum flow variations, in contrast to curves NC1 and NC2, and similar to the flow consistency obtained when a flow controller was used. It will be understood by those skilled in the art that the needle valve can be used to set the alum flow rate at a desired level, regardless of the air pressure supplied, so that, for example, at 60 psi air pressure, the alum flow could be adjusted from zero to 1 liter/minute (or more) and at any level in between; the flows for the 40, 60 and 85 psi air pressure were different only for visualization purposes.

The viscous, hydraulic slurry can be any viscous slurry such as a cementitious slurry or an asphalt-based slurry. The preferred slurry is the fireproofing composition sold by W. R. Grace & Co.-Conn. as Monokote®; however, other useful slurries include gunite or stucco. The preferred low viscosity fluids are accelerators which are added to the viscous slurry to decrease its set time upon a substrate. Any acidic set accelerating agent capable of satisfactorily offsetting the retardation of the slurry can be used. For most commercial applications, the type and amount of accelerator is that which rapidly converts the setting time from about 4 to 12 hours to about 20 minutes. It is usually preferred to employ an accelerator in an amount which results in a setting time of about 5 to 10 minutes. The amount required to provide such setting times will vary depending on the accelerator and the type and amount of retarder and binder. Generally, an amount in the range of about 0.1% to 20% by weight of dry accelerator based upon the weight of dry fireproofing is used, with 2% being preferred. Examples of useful accelerators are aluminum sulfate, aluminum nitrate, ferric nitrate, ferric sulfate, ferric chloride, ferrous sulfate, potassium sulfate, sulfuric acid, and acetic acid, with aluminum sulfate being preferred.

The location of the flowing low viscosity fluid is substantially in juxtaposition to a wall of the distributor. The directing and positioning means can therefore be appropriately located to intercept the stream and direct it toward the orifice so that it can be substantially evenly dispersed with the slurry. The means for directing and positioning the low viscosity fluid can be the stem of the air injector which is strategically located to intercept the flowing low viscosity fluid. The low viscosity fluid then flows along the stem and is thereby directed toward the orifice. The stem is substantially centrally located with respect to the flowing slurry, so that as the low viscosity fluid reaches the nozzle end of the air injector 5, it is appropriately positioned to be substantially evenly dispersed with the slurry to achieve an acceptable spray pattern.

What is claimed is:

1. An apparatus for controlling the flow of a low viscosity accelerator into a flowing viscous cementitious slurry, comprising:

conduit means operative for flow-through of a cementitious slurry along a first axis, said conduit means having an orifice operative to spray disperse a flowing cementitious slurry;

means for receiving a flowing cementitious slurry into said conduit means;

means for controllably introducing an accelerator fluid into said cementitious slurry flow within said conduit means at a point downstream from said means for receiving said flowing cementitious slurry, said means for introducing said accelerator fluid comprising a member projecting into the conduit means for dispensing said fluid within said slurry flow within said conduit, a fluid line connected to said accelerator fluid introducing member, a storage container for containing said accelerator fluid to be introduced into the cementitious slurry flow, an air-pressure-driven pump for conveying said accelerator fluid through the fluid line from the storage container to said accelerator fluid introducing member, a source of pressurized air for driving said fluid pump, and a needle valve in communication with the pressurized air source and pump, said valve positioned within an air line communicating therebetween, said needle valve thereby operative to regulate pressurized air to said pump whereby said accelerator fluid flow consistency can be substantially maintained despite changes in the height at which said conduit means is held during spray application;

means for injecting an air stem into said conduit means for dispersing said flowing cementitious slurry and said accelerator fluid in a spray from said orifice, said air stem injecting means being aligned with said conduit means spray orifice and being located within said conduit means downstream of said accelerator fluid introducing member, thereby defining a second axis which intersects said first axis along which said cementitious slurry flows within said conduit means; and said accelerator fluid introducing member comprising a tube extending into said conduit means and having a plurality of slits along its length operative to permit said accelerator fluid to be introduced into said flowing cementitious slurry, said plurality of slits being further operative to prevent infiltration by said cementitious slurry and pluggage of said fluid line due to pressure surges within said slurry flow, said accelerator fluid introducing member being disposed along a third axis which intersects said first axis within said conduit means, said accelerator fluid introducing member being further disposed coplanarly with said second axis of said air stem whereby accelerator fluid introduced therethrough impinges upon said air stem and is substantially evenly dispersed within said flowing cementitious slurry.

2. Apparatus according to claim 1, wherein said accelerator fluid introducing member is comprised of a material selected from the group consisting of plastic, rubber, and polyurethane.

3. Apparatus according to claim 1, wherein said accelerator fluid introducing member is disposed at an angle into said conduit means along the direction of said flowing cementitious slurry.

4. The apparatus of claim 1, wherein said accelerator fluid is alum.

5. The apparatus of claim 1 wherein said fluid introducing member has a tubular body projecting into said conduit means and comprises a stretchable material selected from the group consisting of plastic, rubber, and polyurethane, said tubular body further comprising a plurality of slits operative to permit said fluid to be introduced into a slurry flowing within and along said conduit means, said slits being further operative to prevent infiltration of slurry into said tubular body if a surge in slurry pressure exists.

6. The apparatus of claim I wherein said fluid introducing member comprises a check valve operative to prevent pressure surges of slurry within said conduit means from causing slurry from backing up into the fluid line and setting, and thereby plugging the fluid line.

7. The apparatus of claim 1 wherein said accelerator fluid introducing member further comprises a closed end.

8. The apparatus of claim 1 wherein said pump comprises a double-diaphragm air-pressure operated pump.

9. A method for distributing a low viscosity accelerator fluid into viscous, hydraulic slurries at substantially constant flow rates, comprising:

directing a viscous, hydraulic slurry along a flow path to a distribution point within a conduit means defining a first axis of flow, said conduit means having an inlet for said slurry and a spray orifice for exit of said slurry;

injecting an air stem along a second axis which intersects said flow path along said first axis and which is aligned with said conduit means spray orifice;

providing flow regulating means comprising a pressurized air source, a valve in communication therewith and with a pump driven by air pressure from said pressurized air source;

introducing a low viscosity accelerator liquid into said flow path at a substantially constant flow rate through a fluid introducing member having a tube body and slits arranged along said tube body, said member being positioned along a third axis which intersects the slurry flow path and causes said liquid to impinge on said dispersing air stem before said slurry reaches said distribution point by regulating the amount of air flow communicated to said pump via said pressurized air source through said valve.

* * * * *